US006517013B1

(12) United States Patent
Mulholland

(10) Patent No.: US 6,517,013 B1
(45) Date of Patent: Feb. 11, 2003

(54) SPRAY GENERATOR

(75) Inventor: Michael Mulholland, London (GB)

(73) Assignee: Accentus plc, Oxfordshire (GB)

( * ) Notice: Subject to any disclaimer, the term of this patent is extended or adjusted under 35 U.S.C. 154(b) by 0 days.

(21) Appl. No.: 09/588,564

(22) Filed: Jun. 7, 2000

(30) Foreign Application Priority Data

Jul. 31, 1999 (GB) ..... 9917929

(51) Int. Cl.[7] ..... B05B 1/26

(52) U.S. Cl. ..... 239/545; 239/543; 239/554; 239/548

(58) Field of Search ..... 239/543, 545, 239/554, 555, 558, 565, 548

(56) References Cited

U.S. PATENT DOCUMENTS 2,493,982 A * 1/1950 Lee
2,570,828 A * 10/1951 Martin
3,016,949 A * 1/1962 Rabbitt
3,121,639 A * 2/1964 Bauer et al.
4,260,563 A * 4/1981 Brulhet

* cited by examiner

*Primary Examiner*—Christopher Kim
(74) *Attorney, Agent, or Firm*—Fleshner & Kim, LLP

(57) ABSTRACT

A spray generator is provided that generates a spray of droplets by the interaction of opposed jets of fluid. The generator comprises a rigid central member defining a central axis, and fluid passageways formed in a block of material leading to two or more pairs of opposed fluid outlets. The outlets of each pair are separated from each other and arranged to generate opposed jets of fluid along an axis parallel to the central axis. Further, the pairs are equi-angularly spaced about the central axis. The outlets of each pair are maintained in axial alignment with each other and at a predetermined axial spacing from each other by a rigid connection between the central member and the block of material. The two or more pairs of outlets together generate a spray of droplets extending 360 degrees about the central axis.

14 Claims, 6 Drawing Sheets

SPRAY GENERATOR

BACKGROUND OF THE INVENTION

1. Field of the Invention

This invention relates to a spray generator for generating a spray of droplets from the interaction of opposed jets of fluid.

2. Background of the Related Art

Spray generators of this type are known and are used in a variety of applications, e.g. for providing an intimate contact between a gas and a liquid in gas scrubbers, distillation columns, steam and air stripping columns and other mass transfer devices.

GB949954 describes a spray-producing apparatus in which liquid is fed into the opposite ends of a duct having an opening, or slot, in its wall. The two flows of liquid collide with each other and generate a spray of droplets that issue from the slot. The liquid fed to the two ends of the duct is subject to pulsating pressure of different phases. By varying the phase relationship of the two flows, the angle of spread of the spray can be controlled. This apparatus is described as being of use in the brewing industry to spray wort over a filter bed.

U.S. Pat. No. 4,002,293 describes an apparatus for producing liquid sprays, e.g. for fountains or in apparatus such as a dishwasher, in which two jets of pressured streams of liquid are directed at each other along a common axis. Nozzles of different configurations can be used to vary the shape of the spray pattern produced and the sprays may be varied in a regular or random manner by interrupting or varying the pressures of the streams.

EP0331343 and EP0642836 describe a spray generator for use in a gas absorption process. A pair of opposed nozzles are located axially within a vortex chamber and fluid issuing from the nozzles interacts to produce a spray of drops. A uniform cyclic disturbance can be imposed on the flows of liquid to the nozzles to produce a reduction in the droplet size spectrum or an irregular variation may be used to generate a spray pattern which changes in an irregular manner.

SUMMARY OF THE INVENTION

The present invention aims to improve upon this prior art and overcome or reduce some of the problems associated therewith.

According to a first aspect of the invention, there is provided a spray generator that generates a spray of droplets by an interaction of opposed jets of fluid, the generator comprising: a rigid central member defining a central axis, and fluid passageways formed in a block or blocks of material leading to two or more pairs of opposed fluid outlets, the outlets of each pair being separated from each other and arranged to generate opposed jets of fluid along an axis parallel to said central axis and the pairs being equi-angularly spaced about said central axis, the outlets of each pair being maintained in axial alignment with each other and at a predetermined axial spacing from each other by a rigid connection between the central member and the said block or blocks of material, the arrangement being such that, in use, the two or more pairs of outlets together generate a spray of droplets extending 360 degrees about the central axis.

According to a second aspect of the invention there is provided a spray generator for generating a spray of droplets by the interaction of opposed jets of fluid, the generator having a nozzle component which comprises a central member defining a central axis and at least two pairs of opposed fluid outlet, the outlets of each pair being spaced from each other and arranged to provide opposed jets of fluid along an axis parallel to the central axis, the pairs of opposed fluid outlets being equi-angularly spaced around the central axis, and being rigidly connected to the central member to maintain the outlets of each pair in axial alignment with each other and at a predetermined spacing from each other.

According to another aspect of the invention there is provided a vortex chamber or a plurality of vortex chambers each having a spray generator as detailed above mounted therein.

The invention thus overcomes problems associated with the prior art in maintaining the fluid outlets in precise alignment with each other (so they are co-axial) and maintaining them at a pre-set distance from each other, whilst being able to generate a 360 degree spray. A slight misalignment between opposed fluid outlets can skew the spray pattern produced or prevent the desired spray pattern being generated. This is of particular concern when high pressure fluid flows are used, e.g. in a vortex type gas/liquid contactor, as they are sensitive to very small misalignment and the high pressures used can cause the apparatus to distort. The separation between the outlets is also critical to the correct functioning of the generator, the separation typically being equal to the diameter of the outlets. This problem has, in the past, been addressed by making the nozzles and the apparatus on which the respective nozzles are mounted of substantial, rigid construction. However, this leads to an undesirable increase in the size and cost of the apparatus and, particularly with large apparatus, it is still difficult to achieve the required accuracy of alignment and spacing of the nozzles, especially in a situation involving high temperatures and hence significant thermal expansion. To overcome this, nozzles such as those described in EP0331343 and EP0642836 have, in practice, been contained within a support structure such as a cage with two or more rods as tie-bars to hold the nozzles in alignment. These tie bars are mounted around the outer circumference of the nozzles and thus obstruct a portion of the spray issuing from between the nozzles. Also, when spray hits the bars, it is shattered into much smaller droplets which is undesirable in some applications as such small droplets are more difficult to remove from the gas flow before the gas leaves the scrubber.

As indicated above, the present invention uses two or more pairs of outlets and has a central member to maintain the axial alignment and spacing of the outlets of the respective pairs.

Preferred and optional features of the invention will be apparent from the following description and from the subsidiary claims of the specification.

BRIEF DESCRIPTION OF THE DRAWINGS

The invention will now be further described, merely by way of example, with reference to the accompanying drawings, in which.

DETAILED DESCRIPTION OF PREFERRED EMBODIMENTS

Figure 1:
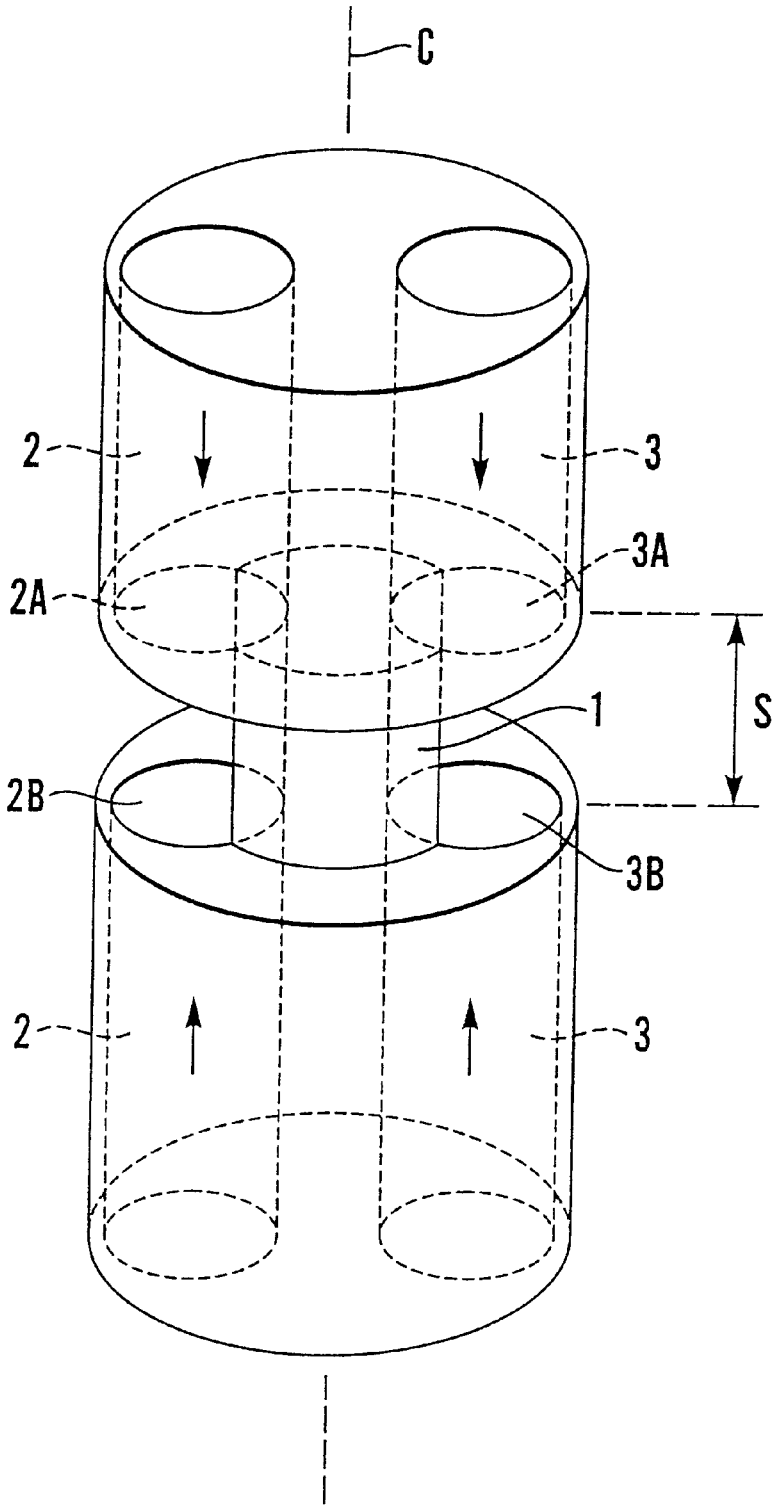
FIG. 1 is a perspective view of a first embodiment of a spray generator according to the invention.
Figure 2:
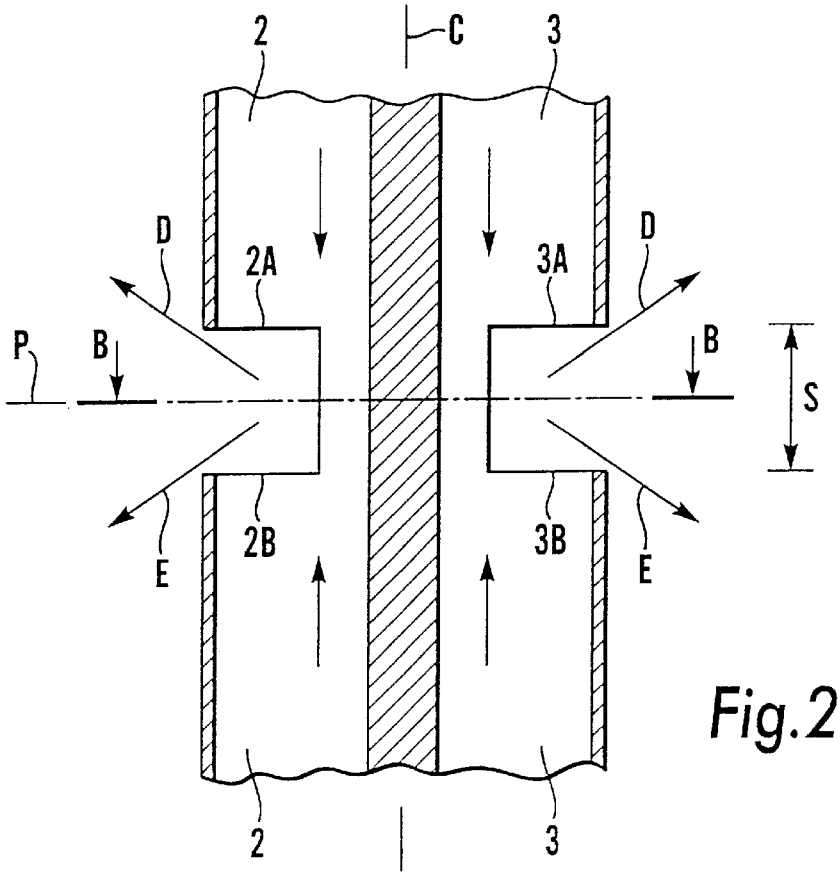
FIG. 2 is a lengthwise sectional view of the spray generator shown in FIG. 1.
Figure 3:
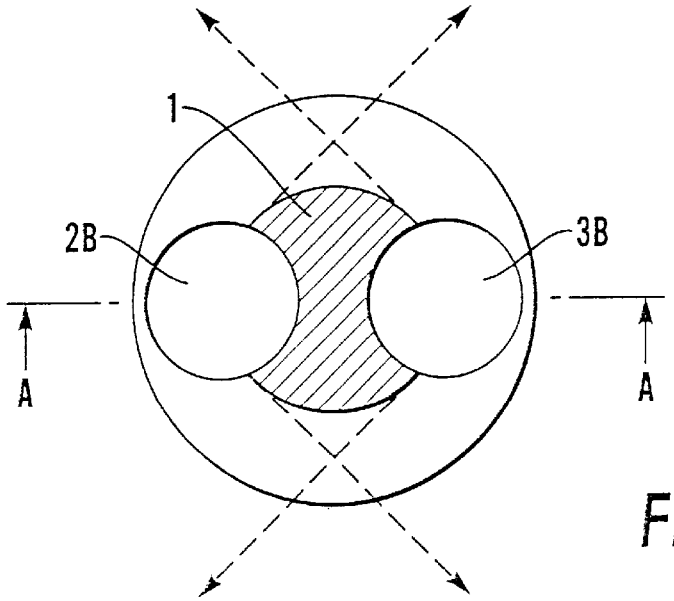
FIG. 3 is a sectional view along line B—B of the spray generator shown in FIG. 2.

FIGS. 1 to 3 show a first embodiment of a spray generator according to the invention. This is preferably machined from a single block of solid material, typically stainless steel, and comprises a central member 1 defining a central axis C, a first pair of opposed outlets 2A, 2B and a second pair of opposed outlets 3A, 3B. The spray generator may be formed by drilling passageways 2, 3 through a block of stainless steel parallel to the axis C leaving a central member 1 therebetween, and removing a central section of the block, apart from the central member 1, so as to form the outlets 2A, 2B, 3A and 3B leading into open areas on opposite sides of the central member 1. The open areas have a width S so the opposed outlets of each pair are separated from each other by a pre-set distance S and arranged to generate opposed jets of fluid (as indicated by the arrows in the Figures) along an axis parallel to the central axis C. If the momentum of the fluid issuing from opposed nozzles is the same and does not vary, the two jets collide and interact to form a spray of droplets in a radially extending sheet substantially in the plane P which is perpendicular to the central axis C and equally spaced from the opposed outlets.

However, in the preferred mode of operation, the fluid flows to the opposed outlets are arranged such that there are random variations in the momentum of the fluid issuing from the outlets so that the sheet of droplets sweeps randomly through an arc (as shown by arrows D,E in FIG. 2) in dependence upon the size of the random variations in the momentum of the fluid issuing from the outlets. These variations may occur rapidly and the movement and variations in the spray pattern produced effectively fills the area around the generator with fine droplets.

The passageways 2,3 are preferably tubular with circular cross-sections and the outlets 2A, 2B and 3A, 3B are preferably circular, but may be of other cross-sectional shape. The sides of the central member 1 are preferably contiguous with or adjoin sides of the respective pairs of outlets 2A, 2B and 3A, 3B and the passageways leading thereto.

As shown in FIG. 3, the curved side walls of the passageways 2,3 may form sides of the central member 1.

The two pairs of outlets 2A, 2B and 3A, 3B are angularly spaced from each other by 180 degrees about the central axis as shown in FIG. 3. The spread of the spray pattern produced by each pair of outlets is determined by the shape and position of the central member 1 relative to the outlets and, as shown by the dashed lines in FIG. 3 which indicate the maximum spread of the spray patterns from each pair of outlets. The arrangement is such that the two pairs of outlets together generate a spray pattern extending 360 degrees about the central axis C. To achieve this, the opening between the opposed outlets extends at least 180 degrees about the axis of the outlet and preferably at least 220 degrees about the axis thereof.

The central member 1 is designed to be sufficiently large and rigid to maintain the outlets 2A, 2B, 3A and 3B in fixed positions.

Figure 6:
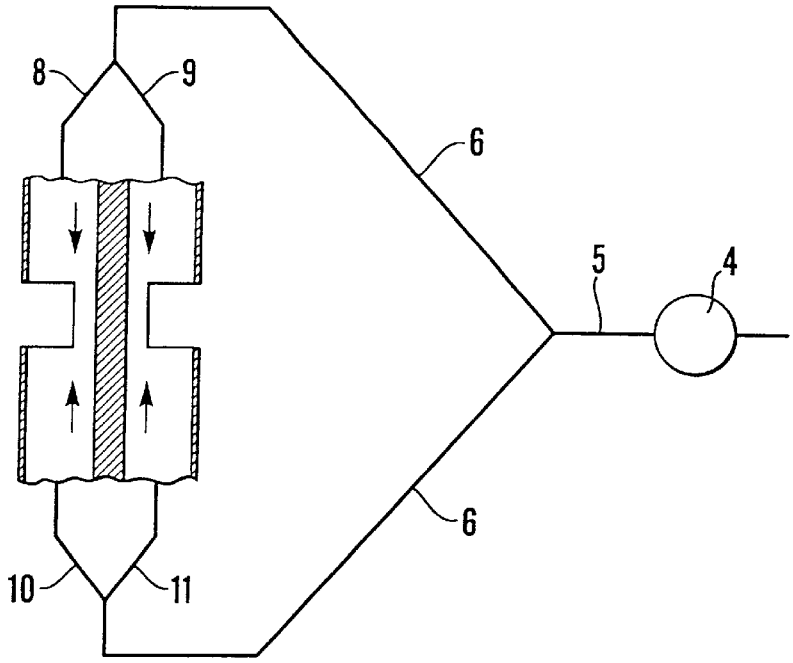
FIG. 6 is a schematic diagram showing how the first embodiment may be connected to a source of fluid.

As shown in FIG. 6, a fluid generator, such as that shown in FIGS. 1 to 3 may be connected to a source of fluid, e.g. a pump 4, by fluid flow lines. A first flow line 5 is connected to the pump 4 and divides into two lines 6 and 7. Line 6 leads to one end of the spray generator and further divides into lines 8 and 9 which lead, respectively, to outlets 2A and 3A. Line 7 leads to the other end of the spray generator and further divides into lines 10 and 11 which lead, respectively, to outlets 2B and 3B. Alternatively, a single flow line may lead to the two outlets 2A and 3A, i.e. flow lines 8 and 9 may be combined as one wide flow line.

In order to generate random variations in the momentum of fluid issuing from the outlets 2A, 2B, 3A and 3B as described above, the fluid flow in the fluid lines should preferably be turbulent or at least partially turbulent, e.g. have a Reynolds number greater than the Critical Reynolds Number.

Turbulence can be achieved in a variety of ways and depends on the nature of the fluid, the pressure at which the fluid is supplied, the shape of the fluid pathways and the roughness of the walls thereof.

Figure 4:
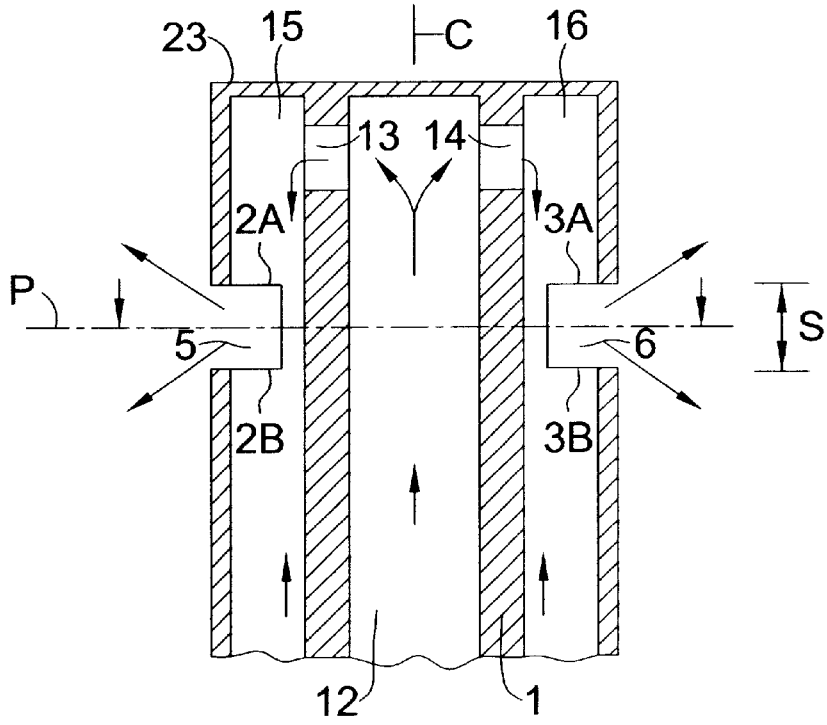
FIG. 4 is a sectional view of a second embodiment of the invention.
Figure 5:
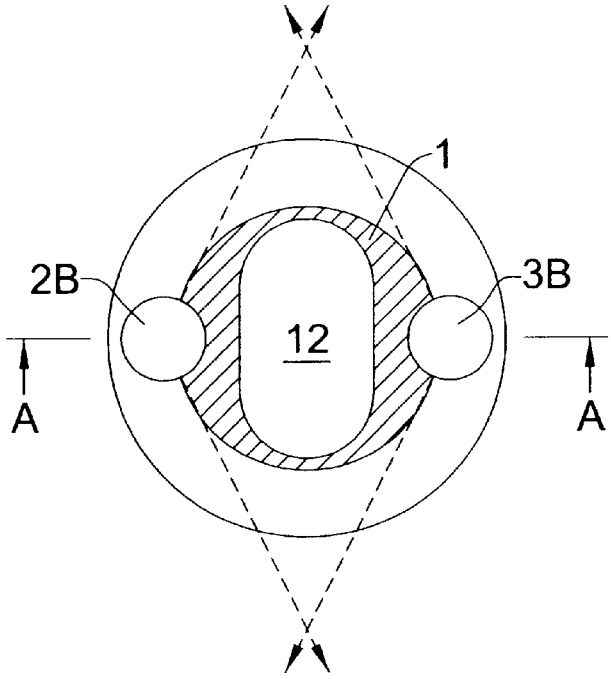
FIG. 5 is a sectional view along line B—B of the spray generator shown in FIG. 4.

FIGS. 4 and 5 show a second embodiment of a spray generator according to the invention. In this embodiment, a fluid flow line leading to outlets 2A and 3A is formed within the central member 1. By this means, fluid lines only need to be connected to one end of the spray generator. This has significant advantages in applications in which the fluid generator is mounted adjacent an orifice and it is desired to minimise any restriction within this orifice, as described below in relation to FIG. 8.

As shown in FIG. 4, fluid passes along a passageway 12 within the central member 1 and passes through ports 13 and 14 in the side wall of the central member 1 into passageways 15 and 16 which lead to the outlets 2A and 3A, respectively. In passing through these passages, the direction of fluid flow is turned through 180 degrees so fluid issuing from outlets 2A and 3A is travelling in the opposite direction to fluid issuing from outlets 2B and 3B.

The second embodiment is also preferably machined from a solid block of material, such as stainless steel, and the passageways formed by drilling.

As shown in FIG. 5, the passageway 12 may have an elongate cross-section. This helps increase the cross-section of the passageway without increasing the distance between the two pairs of outlets 2A, 2B and 3A, 3B.

As in the first embodiment, the openings between the outlets and the shape and size of the central member 1 are arranged so that the two pairs of outlets together generate a spray pattern extending 360 degrees about the central axis C.

Figure 7:
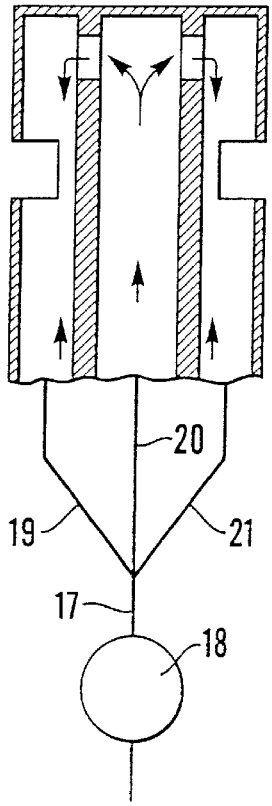
FIG. 7 is a schematic diagram showing how the second embodiment may be connected to a source of fluid.
Figure 8:
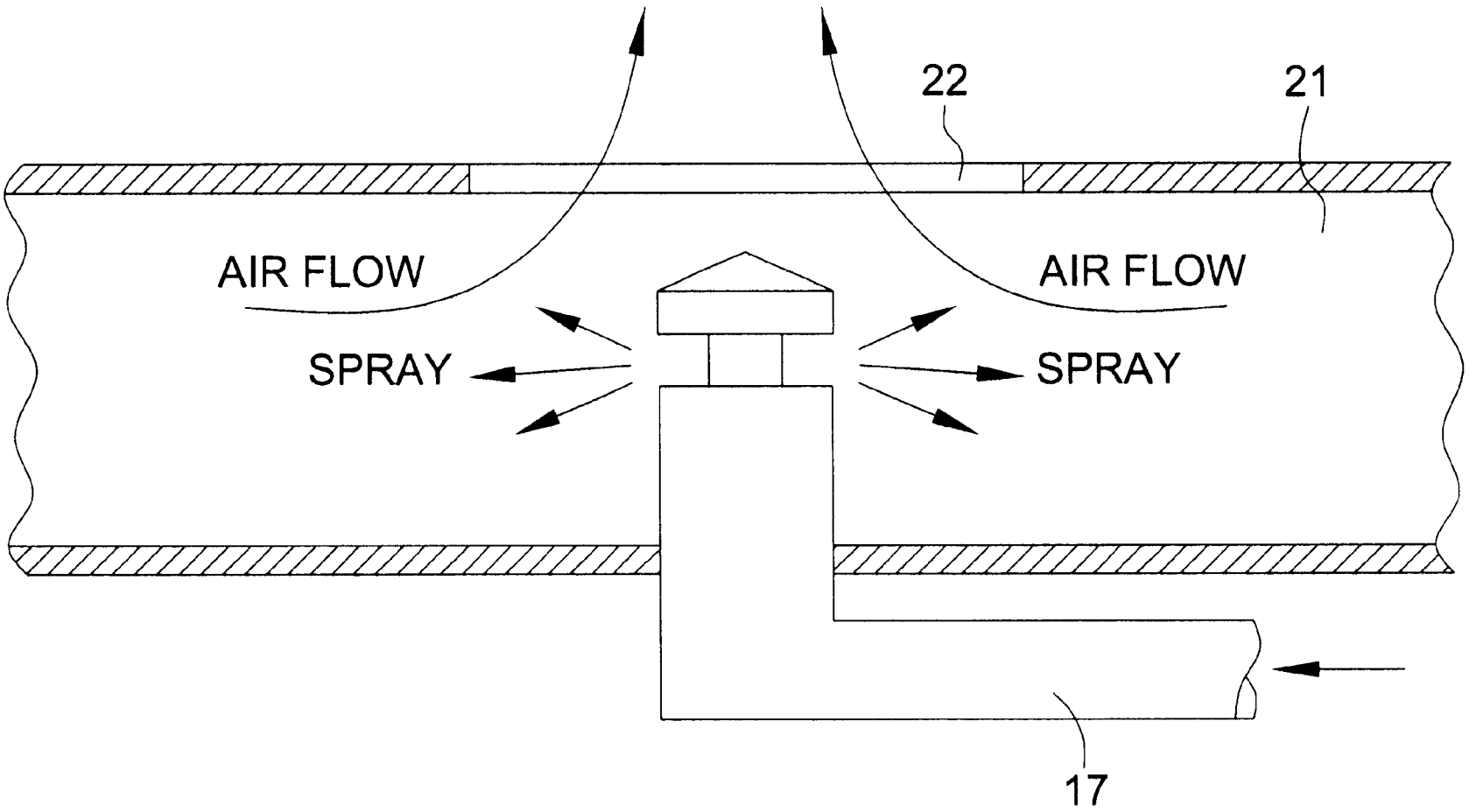
FIG. 8 is a diagram showing an application of the second embodiment.

FIG. 8 shows the application of this second embodiment in a vortex chamber 21. The spray generator is mounted in the centre of the chamber 21 with fluid supplied thereto by fluid line 17 (which corresponding to fluid line 17 of FIG. 7). Air is fed into the chamber 21 at the periphery thereof so as to form a vortex therein and migrates towards the centre of the chamber 21 to an exit port 22. Exit port 22 is not obstructed by the spray generator or by fluid lines leading thereto. If a spray generator such as that shown in FIGS. 1–3 were used in such an arrangement, the exit port 22 would be partially obstructed which would lead to a higher pressure drop (which is undesirable in some applications) or the port would have to be increased in size, which would be undesirable as this leads to increased droplet entrainment in the gas flow.

It should be noted that the accompanying Figures are schematic and the relative dimensions of the components, e.g. the cross-sectional areas of the outlets 2A, 2B, 3A and 3B, may differ from that shown. The outlets 2A, 2B, 3A, 3B may vary widely in size depending on the application, eg. from 2 mm diameter to 60 mm or more in diameter, but would typically be in the range 3 mm to 20 mm.

The separation between outlets 2A and 3A and between outlets 2B and 3B, and hence the width of the central member 1 therebetween is preferably at least half the diameter of the outlets and may be equal to or greater than the diameter of the outlets.

FIG. 7 shows the fluid flow lines for the second embodiment. A first flow line 17 from a pump 18 divides into three flow lines 19, 20 and 21. Flow lines 19 and 21 lead to outlets 2B and 3B, respectively, and flow line 20 leads to the passageway 12 described above. Alternatively, a single flow line may lead to the outlet 2B and 3B and the passageway 12, i.e. flow lines 19, 20, and 21 be combined as one wide flow line.

As indicated above, the spray generator is preferably manufactured from a single piece of metal so the central member 1 and the parts defining the outlets 2A, 2B, 3A and 3B are integrally formed. This leads to a robust construction in which the required alignment and spacing of the outlets can be easily determined and maintained. The parts may, however, be formed separately and rigidly secured to each other, e.g. by welding. A nozzle component comprising the central member 1 and the outlets 2A, 2B, 3A and 3B may also be secured to or within a further component comprising passageways leading to the outlets of the nozzle component.

With such a construction, the outlets and passageways leading thereto may, as indicated above, conveniently be formed by drilling or other machining operations. In contrast, the prior art is fabricated from pipes and nozzles.

Alternatively, spray generators according to the present invention may be formed as a casting or as a moulding, if formed of a non-metallic material, e.g. a plastics material.

Although the central member 1 and the outlets 2A, 2B, 3A and 3B of the second embodiment are also preferably formed from a single piece of material, the end 23 thereof may be a separate component which is secured thereto to allow the fabrication of the ports 13 and 14.

Figure 9:
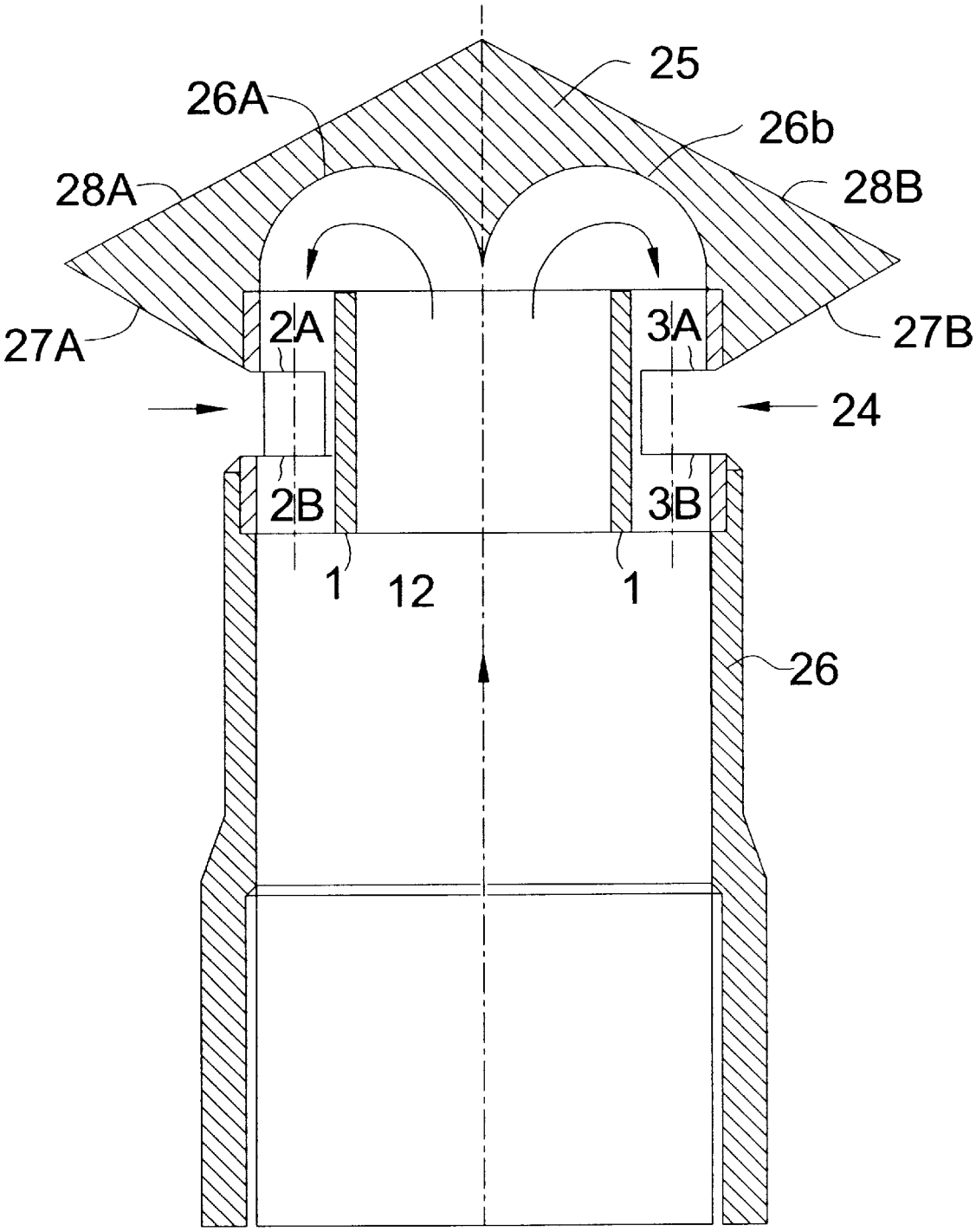
FIG. 9 is sectioned view of a modified form of the second embodiment.

FIG. 9 shows a cross-sectional view of a modified form of the second embodiment. This comprises a nozzle component 24 one end of which is mounted to an end piece 25 and the other end of which is mounted to an inlet passageway 26.

The nozzle component 24 may be similar to the spray generator shown in FIG. 1, but with a passageway 12 formed within the central member 1, or similar to the spray generator shown in FIG. 4 but without the end piece 23 or ports 13 and 14. As before, the nozzle component 24 is preferably formed from a single piece or block of material so the alignment and spacing of opposed pair of outlets 2A, 2B and 3A, 3B are maintained by a rigid connection with the central member 1.

The end piece 25 comprises internal curved walls 26A, 26B positioned to receive the flow of fluid from passageway 12 and divide this into separate flows of fluid directed to the outlets 2A and 3A. The end piece 25 is preferably provided with deflector surfaces 27A, 27B which prevent spray issuing from the nozzle component 24 from being directed towards an exit port 22 such as shown in FIG. 8. The upper surfaces 28A, 28B of the end piece are preferably sloping, or curved, to prevent fluid from collecting on top of the spray generator.

The outlet passageway 26 preferably comprises a single, wide passageway from which fluid enters the central passageway 12 and the passageways leading to the outlets 2B and 3B.

The nozzle component 24 is preferably secured to the end piece 25 and the outlet passageway 26 by welding it thereto. The nozzle component 24 and inlet passageway 26 may also be formed as one component.

The embodiments described above comprise two pairs of outlets angularly spaced by 180° about the axis C. Three pairs of outlets angularly spaced from each other by 120° about the axis may also be used. Four or more pairs of outlets may also be used in some circumstances.

As mentioned above, spray generators of the type described can be used in a variety of applications, in particular as a vortex chamber for use in gas scrubbing and other applications as mentioned above. A single chamber may be used or a plurality may be used in a series or cascade so the output of the first chamber is fed into the second chamber and so on. Such arrangements are further described in GB2282983 mentioned above. The vortex chambers may be cylindrical or may have a polygonal shape, e.g. square or hexagonal.

What is claimed is:

1. A spray generator for generating a spray of droplets by an interaction of opposed jets of fluid, the generator comprising:

a rigid central member defining a central axis; and a plurality of fluid passageways formed in at least one block of material leading to at least two pairs of opposed fluid outlets, the opposed fluid outlets of each pair being separated from each other and arranged to generate opposed jets of fluid along an axis parallel to said central axis and each pair being equi-angularly spaced about said central axis, the opposed fluid outlets of each pair being maintained in axial alignment with each other and at a predetermined axial spacing from each other by a rigid connection between the central member and the at least one block of material, wherein the at least two pairs of opposed fluid outlets together generate a spray of droplets extending 360 degrees about the central axis, wherein outer side walls of the central member are coincident with inner edges of the respective pairs of opposed fluid outlets and extend therebetween.

2. The spray generator according to claim 1, wherein the central member and the at least one block of material are formed from a single piece of material.

3. The spray generator according to claim 1, wherein the plurality of fluid passageways comprise drillings within the at least one block of material.

4. The spray generator according to claim 1, wherein the opposed fluid outlets are formed at ends of the fluid passageways, which are tubular, and portions of the outer side walls of the central member are formed as continuous extensions of portions of the tubular inner side walls of the fluid passageways which thereby have an outwardly concave part tubular shape and extend between respective pairs of opposed fluid outlets.

5. The spray generator according to claim 1, further comprising:

a fluid passageway provided within the central member.

6. The spray generator according to claim 5, wherein one end of said fluid passageway provided within the central member is in communication with said fluid passageways leading to one pair of said fluid outlets.

7. The spray generator according to claim 1, wherein a first pair of said at least two pairs of opposed fluid outlets is located on one side of the central member and a second pair of said at least two pairs of opposed fluid outlets is located on an opposite side of the central member.

8. The spray generator according to claim 7, wherein the opposed fluid outlets have a diameter D and the first and second pairs of opposed fluid outlets are spaced from each other by a distance in the range D/2 to D.

9. A vortex chamber having the spray generator according to claim 1 mounted therein.

10. The spray generator according to claim 1, wherein outer side walls of the central member form a substantially continuous surface with inner side walls of the fluid passageways leading to the opposed fluid outlets.

11. A spray generator for generating a spray of droplets by an interaction of opposed jets of fluid, the generator having a nozzle component which comprises:

a central member defining a central axis; and at least two pairs of opposed fluid outlets, the opposed fluid outlets of each pair being spaced from each other and arranged to provide opposed jets of fluid along an axis parallel to the central axis, each pair of opposed fluid outlets being equi-angularly spaced about the central axis and being rigidly connected to the central member to maintain the opposed fluid outlets of each pair in axial alignment with each other and at a predetermined spacing from each other, wherein outer side walls of the central member are coincident with inner edges of the respective pairs of opposed fluid outlets and extend therebetween.

12. The spray generator according to claim 11, wherein a fluid passageway is provided within the central member.

13. The spray generator according to claim 12, further comprising:

an end piece having internal curved surfaces that receive fluid from one end of said fluid passageway provided within the central member and that direct it to a respective outlet of each pair of opposed fluid outlets.

14. The spray generator according to claim 12, further comprising:

an inlet passageway that directs fluid to a second end of said fluid passageway provided within the central member and to a respective outlet of each pair of opposed fluid outlets.

* * * * *